US007494111B2

(12) United States Patent
Short

(10) Patent No.: US 7,494,111 B2
(45) Date of Patent: Feb. 24, 2009

(54) PORTABLE COLLAPSIBLE SAFETY BARRIER

(75) Inventor: Brent Short, Boston, MA (US)

(73) Assignee: Flex-Safe, Inc., Boston, MA (US)

( * ) Notice: Subject to any disclaimer, the term of this patent is extended or adjusted under 35 U.S.C. 154(b) by 4 days.

(21) Appl. No.: 10/958,166

(22) Filed: Oct. 4, 2004

(65) Prior Publication Data

US 2005/0087732 A1 Apr. 28, 2005

Related U.S. Application Data

(60) Provisional application No. 60/513,890, filed on Oct. 24, 2003.

(51) Int. Cl.
*E04H 17/16* (2006.01)

(52) U.S. Cl. ..... 256/26; 256/27; 256/DIG. 6; 160/136; 160/137; 160/135

(58) Field of Classification Search ..... 256/1, 256/13.1, 24, 25, 26, 27, DIG. 6; 404/6, 404/9; 116/63 R, 63 P; 160/136, 137, 141, 160/144, 152, 162, 163, 164, 165
See application file for complete search history.

(56) References Cited

U.S. PATENT DOCUMENTS 2,221,357 A * 11/1940 Moore et al. ..... 404/9
2,892,492 A * 6/1959 Jackoboice ..... 160/135
3,145,766 A * 8/1964 Wickham et al. ..... 160/136
4,118,065 A * 10/1978 Watkins ..... 297/45
4,717,201 A * 1/1988 Barras ..... 297/16.2
5,460,353 A 10/1995 Rittenhouse ..... 256/1
5,544,614 A * 8/1996 Cushman ..... 116/63 P
5,704,592 A * 1/1998 White et al. ..... 256/25
6,079,157 A 6/2000 Hincher ..... 49/57
6,676,113 B2 1/2004 Christensen ..... 256/25
6,691,467 B2 2/2004 Hincher ..... 49/463
6,966,084 B2 * 11/2005 Le Gette et al. ..... 5/129
7,189,164 B1 * 3/2007 Paesang et al. ..... 472/118

* cited by examiner

*Primary Examiner*—Michael P Ferguson

(57) ABSTRACT

A collapsible barrier system that is lightweight and meets existing safety regulations is disclosed. The barrier system has support members that are hinged to form a three dimensional structure. The structure may also have handles used in deployment and transportation of the barrier and vertical posts that support a web providing both additional structure as well as a message medium. The system can be used in a variety of temporary barrier applications both indoors and outdoors and may be enhanced with audio and/or illuminated signals.

16 Claims, 11 Drawing Sheets

PORTABLE COLLAPSIBLE SAFETY BARRIER

The present invention claims priority of a previously filed Provisional application filed on Oct. 24, 2003 (Ser. No. 60/513,890)

FIELD OF INVENTION

The present invention is directed to portable safety barriers used to re-direct people and traffic.

BACKGROUND OF INVENTION

The present invention relates in general to defining perimeters such as those for work-safety zones. In particular this invention presents a portable free-standing collapsible barrier system, which can be modular and interlocking, for use in directing the public past temporary work sites involving general construction, servicing utilities, maintaining roads, sidewalks, trees and similar activities.

While temporary safety barriers of various kinds have been used at outdoor and indoor work locations for many years to delineate an area against vehicle or personal entry, presently available systems have a number of drawbacks. It is desirable to have lightweight barriers that are still stable. Therefore a ways to fill barriers on a site with water or other heavy material such as sand have been provided. One instance of this approach is the US patent of Rittenhouse (U.S. Pat. No. 5,460,353), incorporated herein by reference. Another approach is to use legs that can be rotated into an extended position as in US patent of Christensen (U.S. Pat. No. 6,676,113), incorporated herein by reference. Both disclosures use rigid sections between end posts.

Still another approach emphasized safety barriers of a lattice type as described and referenced in US patent of White and Polkinghorne (U.S. Pat. No. 5,704,592), incorporated herein by reference. In this disclosure, vertical end pieces are connected to a collapsible/expandable lattice structure of slats that close together in a scissors fashion. A handle is provided for carrying the barrier in a collapsed mode. It further has a detachable base unit in the form of an inverted T including a stem that telescopically engages with a respective upright. Thumbscrews lock the base unit in position. It further discloses a combined flag and lamp bracket and/or a means to hang a sign.

A barrier with signaling is described by Hincher in two US patents (U.S. Pat. Nos. 6,691,467 and 6,079,157), incorporated herein by reference. Hincher's barrier includes an electrically operated light arranged to illuminate the barrier directly and/or to project a visible signal away from the barrier. The barrier includes an electrical system having a battery or plug and cord to supply power, controls and conductors connecting the light, power source, and controls.

SUMMARY OF THE INVENTION

The present system provides a barrier that is lightweight, portable, and collapsible, yet designed to provide a stable framework for conveying messages and restricting access. The system may be enhanced with audible and/or visual alarms.

In a first aspect, the present invention provides a portable barrier having an end piece connected to a collapsible/expandable lattice structure comprised of supports that close together in a scissors fashion. A handle is provided carrying the barrier in its collapsed mode, along with a means to secure it in the collapsed mode and one or more grips to assist in deploying and collapsing the barrier from a single point. The disclosed structure forms three-dimensional barrier, since the supports both open up lengthwise from a primary end piece and widthwise to the sides forming two or more "A" shaped structures that inter-connect with other frame members. The "A" type structures provide for increased stability while in the deployed mode.

In a second aspect, the invention provides an expandable safety barrier with an open frame made of members attached at the top and linked near the center by braces. The braces are hinged so they collapse with the barrier and extend with and lock when deployed. A safety and functional advantage of the hinges is gained when they have double pivot points around two ends of a short center section and rotation of the cross members is limited.

In a third aspect of the present invention, some supports have short extensions that protrude at an angle in such a way as to become vertical when the barrier is deployed and provide for support of a banner or other display signage. Such banner or signage may further identify the barrier as blocking a hazard or providing an arrow to re-direct traffic. Typically the banner would be made of a flexible material such as cloth or light plastic, materials that could be colored (as bright yellow) and/or imprinted upon. However, a more rigid display could be mounted on the extensions, such as an elongated computer display, in order to customize a message.

In a fourth aspect of the invention, at least some supports are hollow tubes designed to receive metal rods (such as reinforcing steel rods used in construction), thus adding weight for ballast to further stabilize the barrier in high winds. Such hollow members may have a means to secure the metal rods in place.

In a fifth aspect of the invention, at least one support has a telescoping section for greater ease of deployment and collapsing and better geometry of interconnected members. Such a support can also adapt to uneven surfaces.

In a sixth aspect of the invention, additional signals are provided such as lighting and/or audible alarms that may be activated by electronic control circuitry with or without sensors, such as motion or proximity detection, or a simple on-off switch.

In a seventh aspect of the invention, at least one support is hollow, providing a compartment for housing control circuitry and batteries for signals.

These and other aspects and objects of the present invention will become apparent upon further review of the following specification and drawings.

BRIEF DESCRIPTION OF DRAWINGS

The invention will now be further described, by way of example only, with reference to the accompanying drawings.

DETAILED DESCRIPTION OF THE PREFERRED EMBODIMENT

Figure 1:
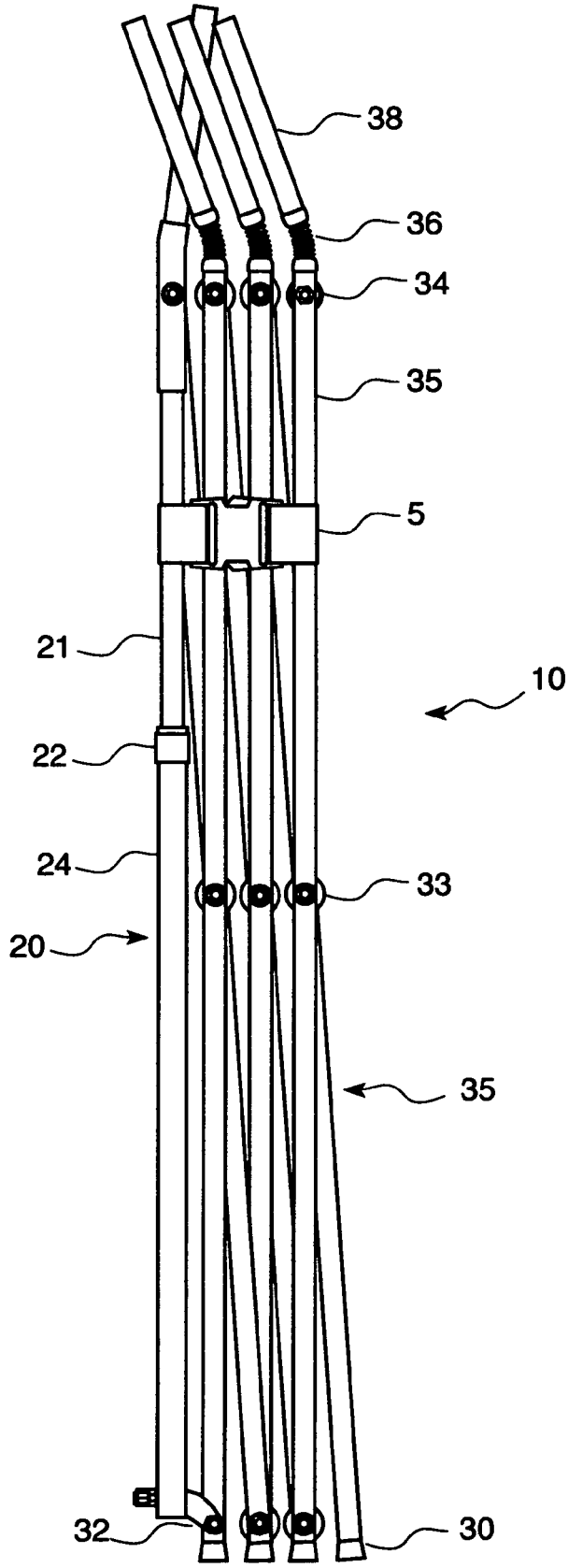
FIG. 1 is a side view of a preferred embodiment of the barrier in fully closed position.

FIG. 1 shows a portable self-contained safety barrier 10 secured in a fully collapsed position secured with a strap and buckle 5 to form a modular longer barrier. The strap and buckle 5 may be used also to secure the barrier to a second barrier. The barrier has four similar series of poles 35. The first series of poles is located frontward and inclined to the left, and the second series of poles is located frontward and inclined to the right, crossing the first series. The third series of poles is located rearward and inclined to the left, and the fourth series of poles is located rearward and inclined to the right crossing the third series of poles. Each series of poles 35 has poles of equivalent lengths. The first and second series of poles, and the third and fourth series of poles are pivotally connected at the midpoints 33 and alternating ends (top 34 and bottom 32). For strength, crossing poles are alternated over and under as shown.

The end pole 20 has an upper telescoping section 21, a lower, larger telescoping section 24, and a sleeve 22 between the two telescoping sections. This telescoping feature allows smooth deployment, without twisting the barrier system. A small curved section connects the bottom of the end pole 29 by a bolt to the bottom pivot joint of the first of the pole series.

Additional features see in FIG. 1 are angle adapters (flexible joints) 36 on top of the poles 35 to accommodate additional short extensions 38 to support signage when deployed. In a preferred mode, these angle adapters 36 are made of flexible steel tubing cemented into the ends of poles 35 and extensions 38 covered by an elastomeric tube. The flexible joint 36, in addition to enabling vertical positioning of banners or signage, enables more compact storage, allowing bending the extensions 38 down toward the body of the barrier when not in use. The extensions 38 may be tubular.

End caps 30 are located on the bottom ends of poles 35 to prevent dirt and water from entering the poles during use. As described in subsequent figures, the type of end cap can vary depending on the location.

Stored in a compact form, this safety barrier can be quickly and easily fully deployed by grasping the two handgrips 39 (shown in FIG. 3) and pushing them apart. Similarly to collapse the barrier, one grasps each of the handgrips and pulls them together. When deployed, the barrier defines and controls traffic around a work zone perimeter. If longer barriers are needed, the interlocking, freestanding, collapsible barriers can be connected to each other by using alternate straps and buckles 5, 6, 7 (shown for example in FIG. 2 and FIG. 3) at each end of the barrier. These barriers are useful in directing traffic past temporary work sites such as general construction, servicing utilities, maintaining roads, sidewalks, trees and similar activities.

Figure 2:
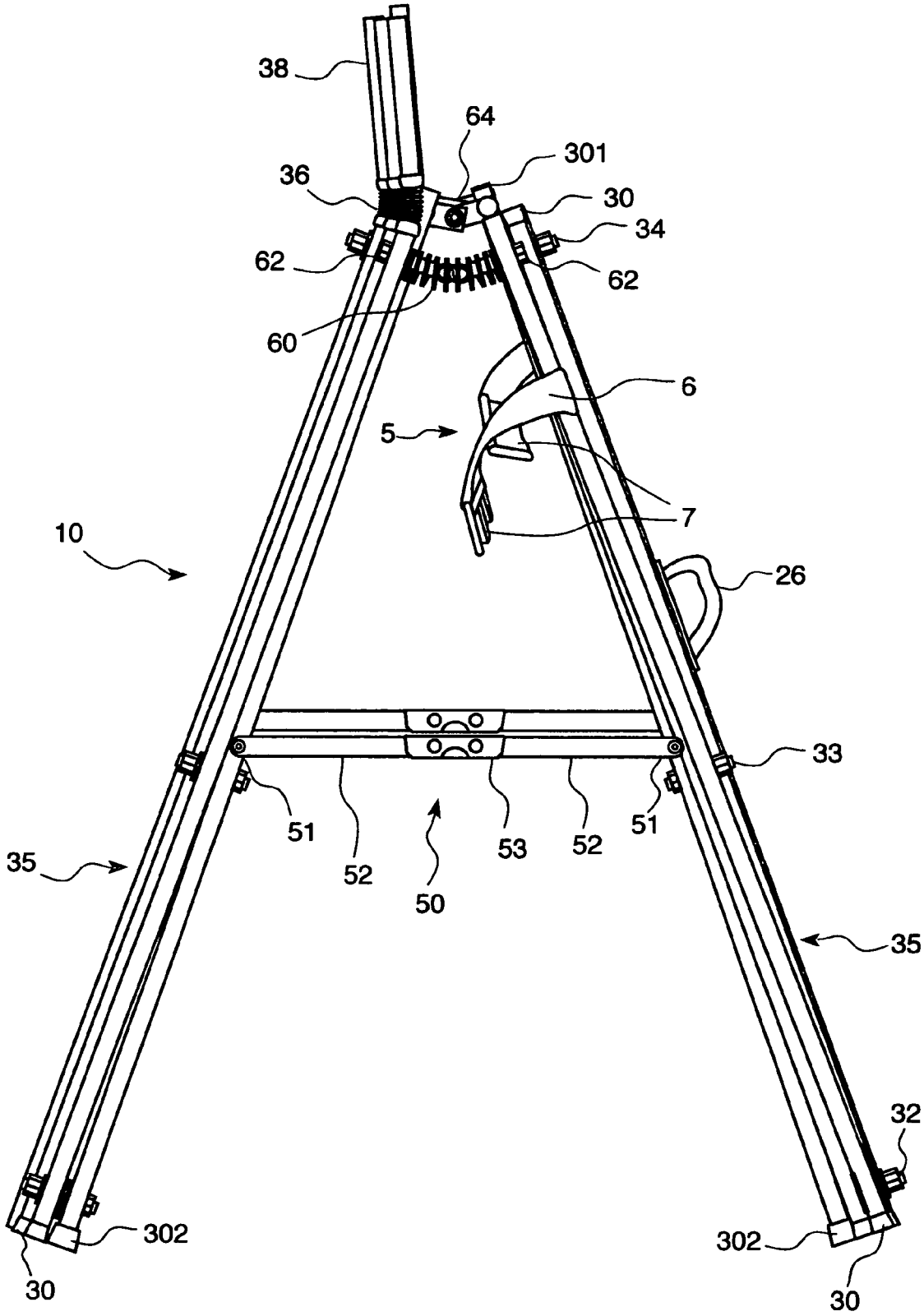
FIG. 2 is an end view of a preferred embodiment of the barrier in full depth extension.
Figure 6A:
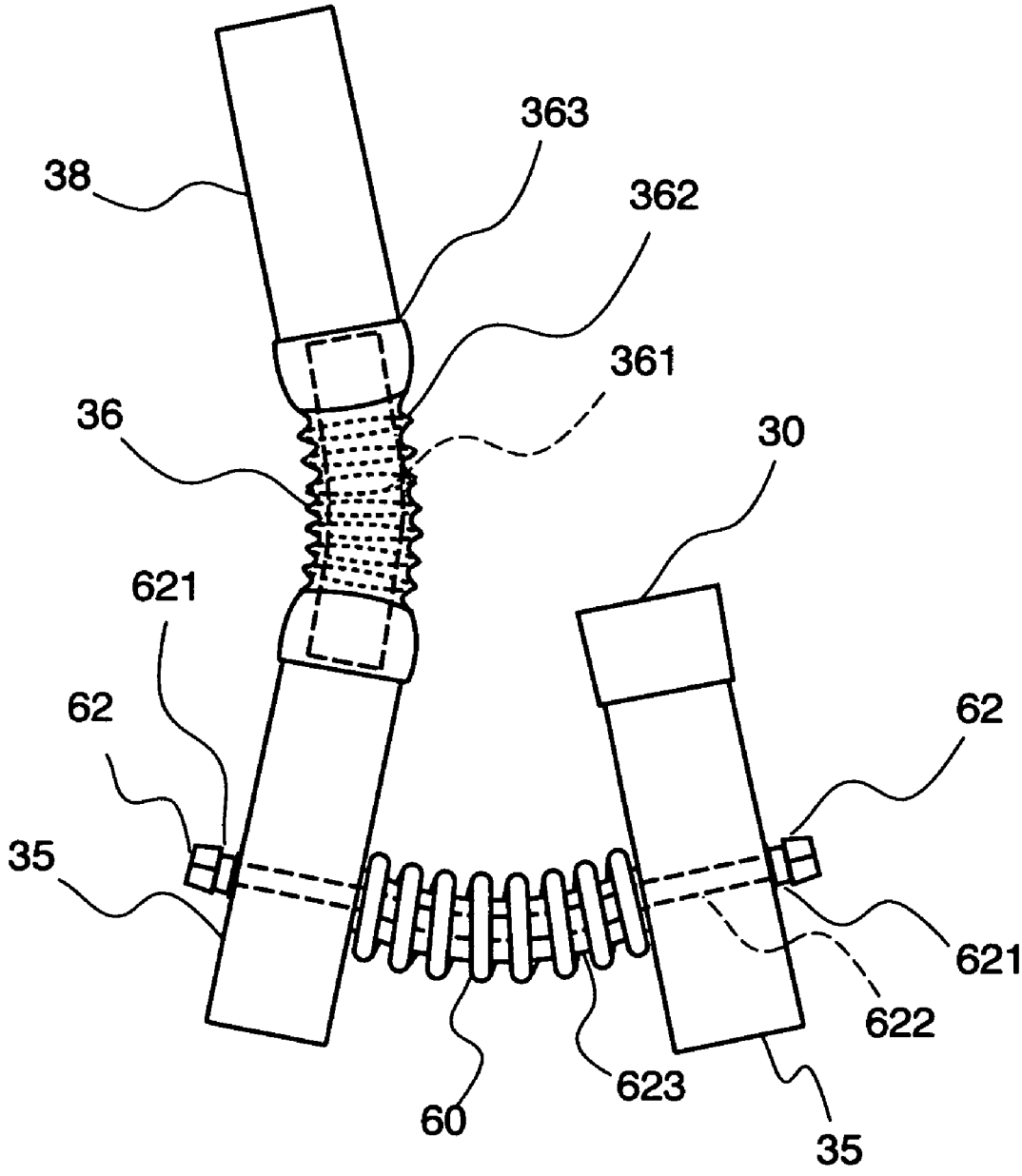
FIG. 6 is a detail view of attachments
Figure 6B:
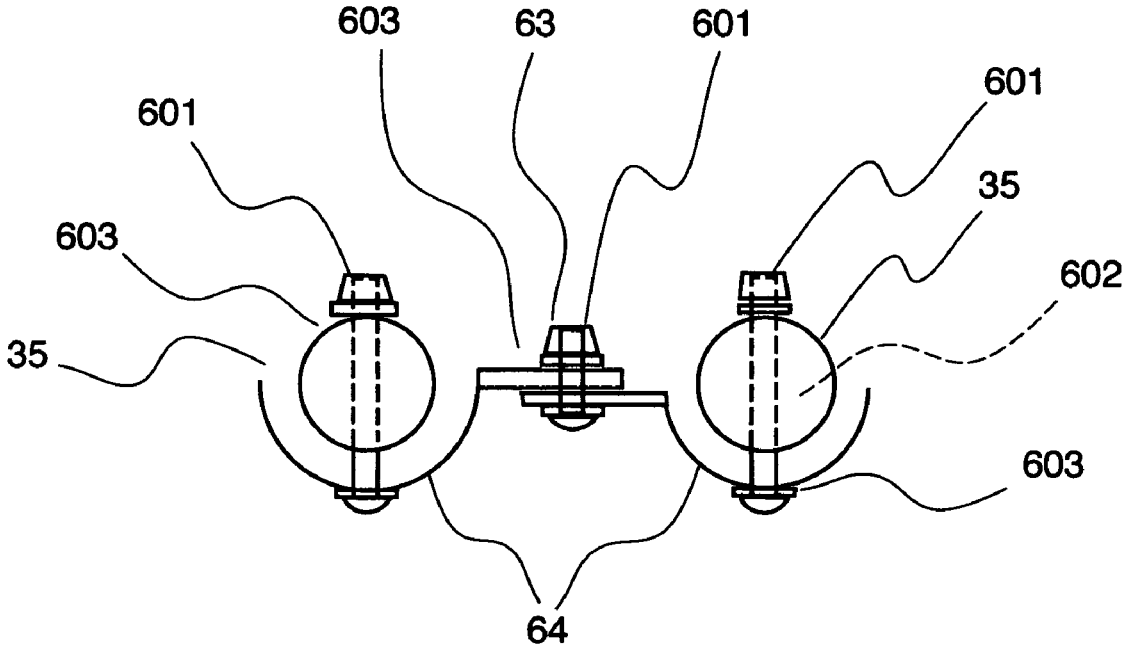
Figure 6C:
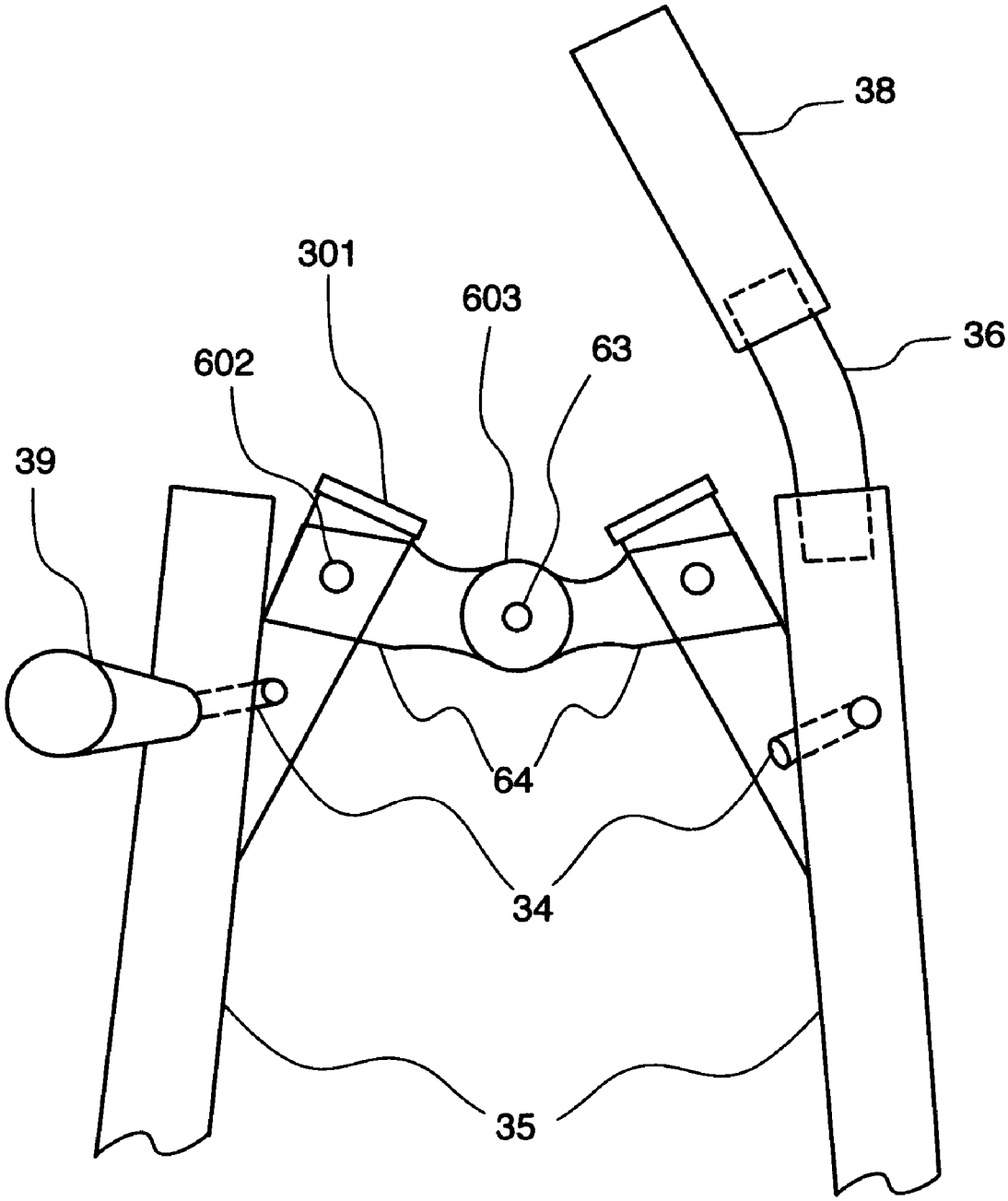

As seen in FIG. 2 and FIG. 6*b* and FIG. 6*c*, the barrier has 'top' hinges 64. These join the first and second interconnected series of poles to the third and fourth inter-connected series of poles in such a manner as to allow extension and retraction of the barrier while retaining a continuous, fluid motion. This is accomplished by connecting two halves of each hinge with steel bolts, and connecting each half of each hinge in turn to it's respective series of poles by means of nylon bolts. See FIG. 6*b* and 6*c* for details.

FIG. 2 is an end view of a preferred embodiment of the barrier in full depth extension. The series of poles 35 shown in FIG. 1 are additionally pivotally connected at their top ends with brackets and fasteners 64 enabling outward movement to create depth at the urging of one or more compression springs 60 secured to a pair 62 of poles 35 just below the pivot point. Outward movement is limited by one or more braces 50 having arms 52 made of a rigid material connected pivotally near the midpoints 51 of two poles 35 and having a dual pivot point spreader hinge 53 similar to a stepladder spreader but having two pivot points. Each pivot point of the spreader hinge 53 (also known as a ladder hinge) is connected to an inner end of one of the arms 52. The double pivot points of the hinge provide a smoother action and more secure positioning when deployed than a single pivot point. When the barrier's depth is expanded outward, the brace 50 is fully extended, forming a collapsible "A" shape when viewed across its depth. This configuration allows for both a closed position with the poles 35 tightly grouped and approaching parallel, as well as an 'open' position, with the poles forming a series of dependent 'X's, while the extensions 38 support an attached mesh banner 40 displaying high visibility messaging such as arrows (see FIG. 3-5).

In the extended form shown in FIG. 2, the carrying handle 26 is shown mounted on one of the poles 35.

The fastening mechanism 5 shown in FIG. 1 is further detailed in this view and in this embodiment has two straps 6 attached to different poles 35 on one end and to half a fastener device 7 such as a buckle on the other. While a buckle type fastener is shown, other fasteners could be chosen from a variety of designs including various buckles and clasps or Velcro fabric-type fasteners. These fasteners serve a dual purpose in that in addition to holding the collapse barrier closed for transport, they can be used to connect multiple barriers together.

Signage support members 38 are shown to be approximately vertical when the barrier system is expanded, however, since flexible joints 36 are used the angle can be adjusted according to need. The poles 35 in this embodiment are tubular, and provided with end plugs 301 on the top that fit into the inner diameter of the pole. End caps 30 on then placed on the top and bottom ends of poles 35 to prevent dirt and water from entering the poles 35 while in use. On the top of the poles 35, a combination cap and plug could be used. Poles that become weight bearing when fully extended are fitted with heavy-duty end caps 302 on the lower end. One version of these heavy-duty end caps 302 is similar in functions and properties to rubber tips used on the end of crutches.

Figure 3:
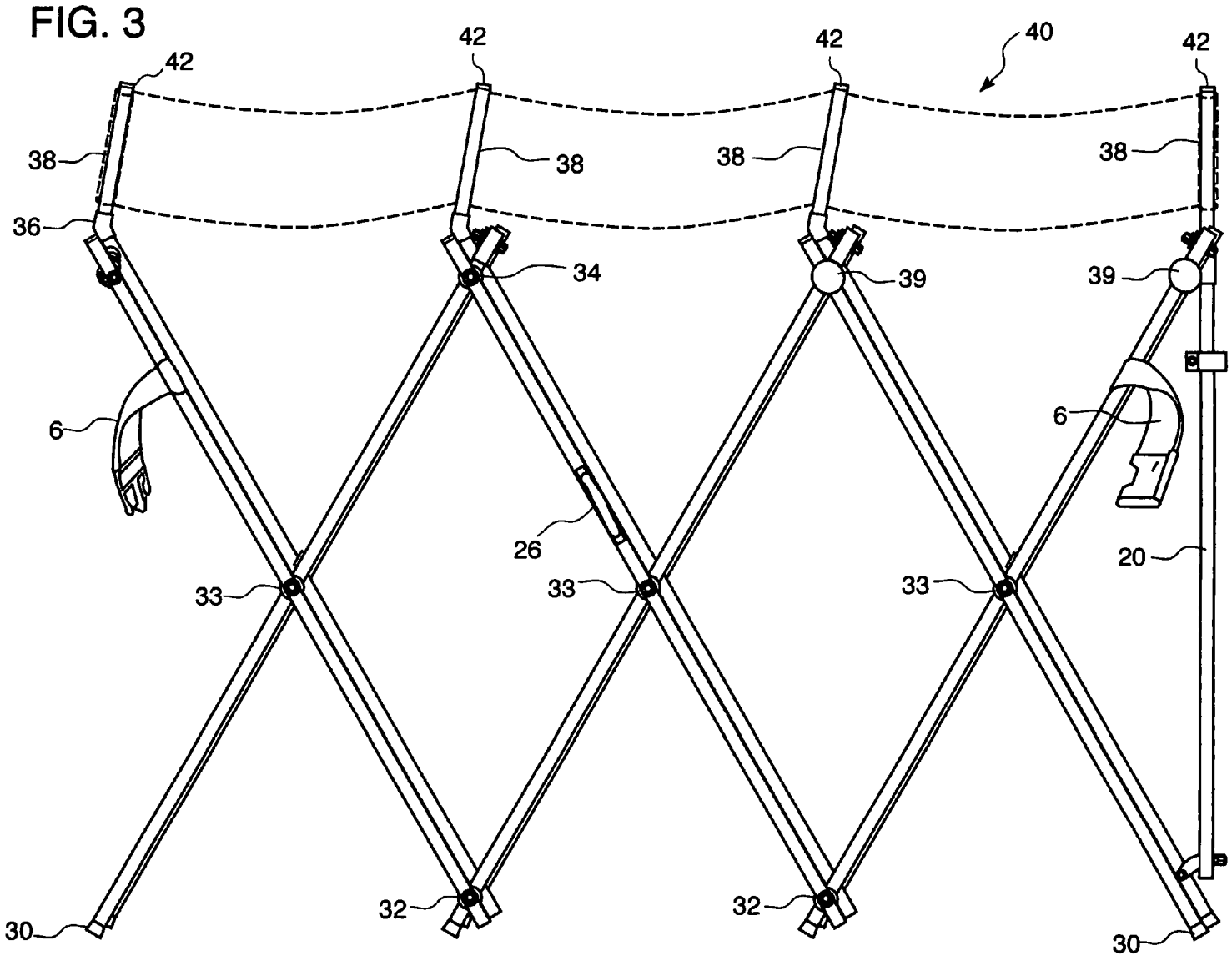
FIG. 3 is a front view of a preferred embodiment of the barrier in partial width extension.

FIG. 3 is a front view of a preferred embodiment of the barrier in partial width extension. Pivot points 34 at the top of the barrier, those in the middle 33 and those at the bottom 32 of the poles 35 have been described in FIG. 1, shown in the collapsed mode. The telescoping end piece 20 is now seen more clearly as to its attachments. The barrier is provided with two handgrips 39 used for grasping and spreading, when deploying or collapsing the barrier. The grips 39 are attached to an elongated bolt used in connecting the poles 35 at two of their pivot points 34. The carrying handle 26 is to a central pole.

In this view, the angle of the sign or banner 50 and the support extensions 38 are not yet vertical and the banner 40 is limp between the extensions 38. A channel in the banner 40 provides a means 42 for attaching the banner 40 to the extensions 38. Pockets or channels in the banner 40 would slide over the extensions 38. Although, in principle, it is only be necessary to have pockets or channels on the end of the banner 40 it is better to also support the banner 40 more centrally. One way to support the banner 40 more centrally is to thread banner 40 through slots provided in central extensions 38 (not shown). There are a number of means of attaching a banner 40 to the extensions 38, including but not limited to, sewn pockets, adhesive strips, grommet and ties, and formed pockets (as heat sealing plastic). The banner 40 may be made from a woven fabric, a plastic sheet or the like. Ease of printing, dying, stability in weather extremes, and availability of bright colors are important characteristics of the material chosen.

Figure 4:
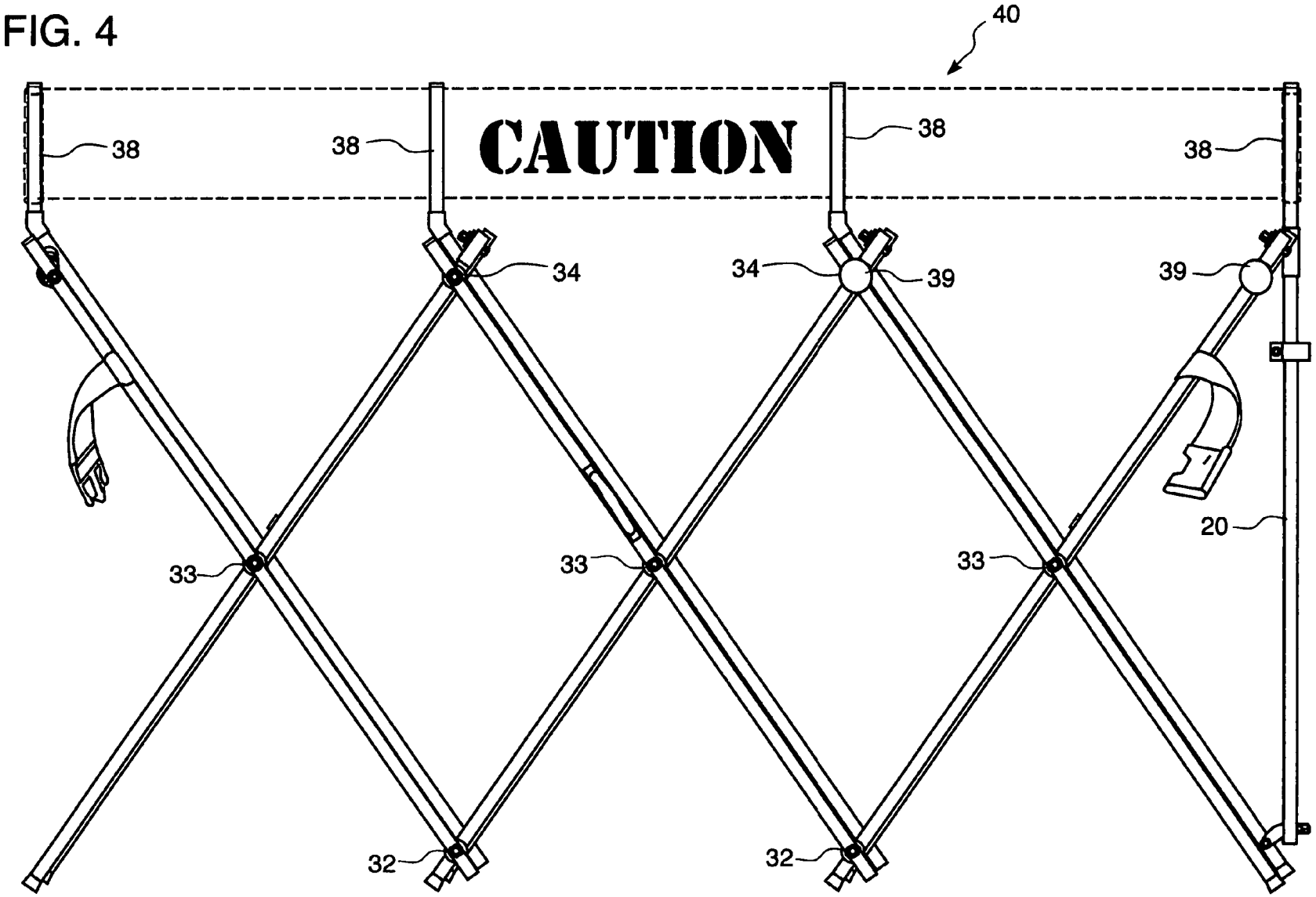
FIG. 4 is a front view of a preferred embodiment of the barrier in full width extension.
Figure 5:
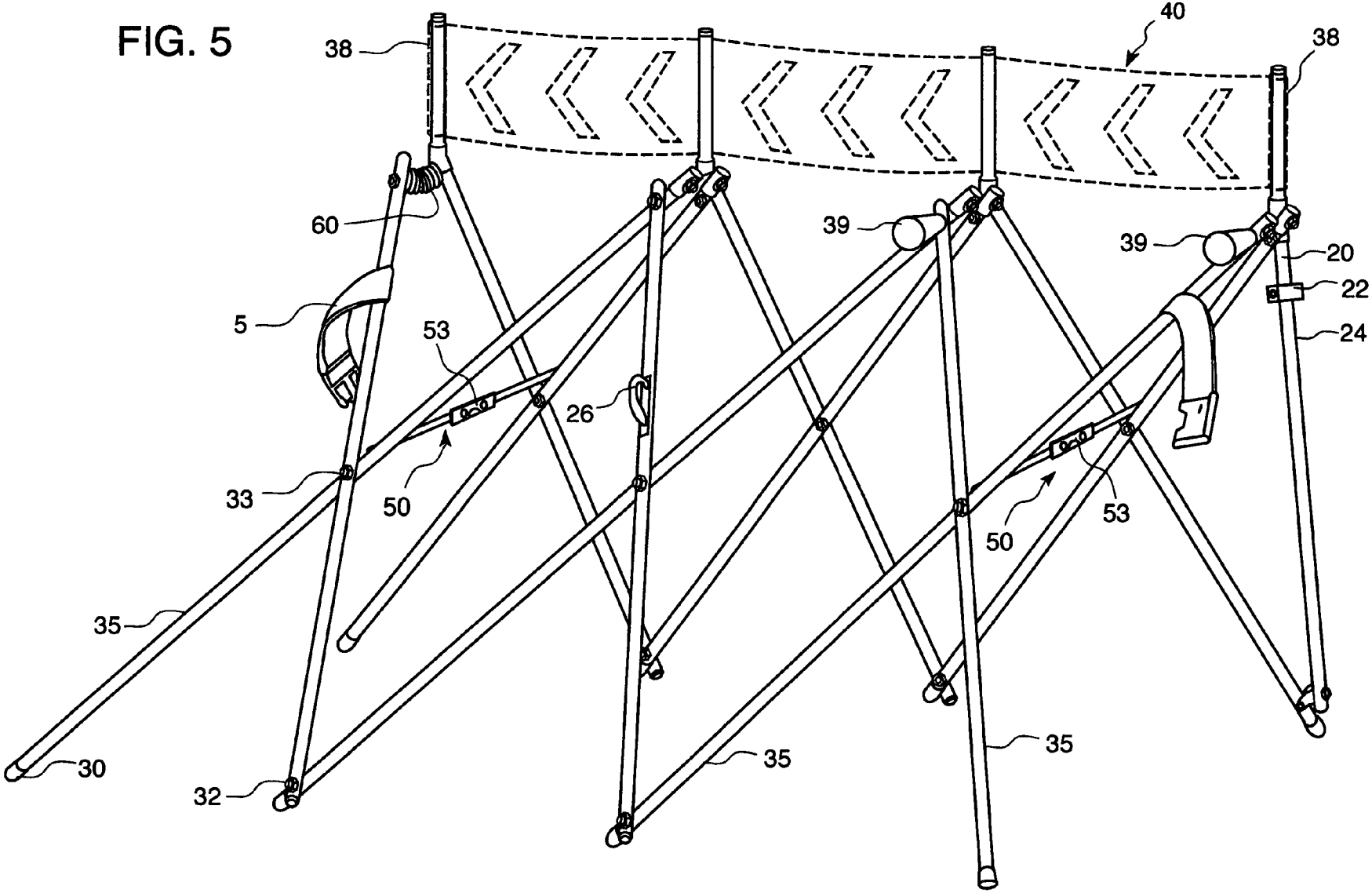
FIG. 5 is a 3-dimensional view of the barrier in both depth and width extension.

While the banner 40 depicted in FIGS. 3-5 suggests a solid banner 40, in could be a rectangular, horizontally positioned porous mesh banner 40 to reduce wind resistance. The banner allows display of such information as arrows or text stating, "work ahead" or "caution". In one embodiment this banner 40 is attached to the main structure of the barrier 10 by means of a series of sleeves sewn into the mesh at regular intervals. These sleeves slide on to the upright extensions 38 situated along the top of the barrier, allowing the banner 40 to deploy and collapse in tandem with the movement of the main body of the barrier. This feature allows for the directional intent of the barrier to be instantly reversed by sliding the banner up off of the upright posts, flipping it over, then sliding it back into position.

FIG. 4 is a front view of a preferred embodiment of the barrier in full width extension. The banner 40 support extensions 38 are now vertical and the banner 40 is taut. A sample message is indicated. Other messages may be visual such as a series of arrows directing pedestrian or vehicular traffic away from the hazard, universal illiterate symbols or yellow or orange and black stripes as common in safety banners.

FIG. 5 shows a 3-dimensional view of a barrier extended in both depth and width. The placement of the two cross braces 50 forms an "A" configuration to secure the barrier in a rigid position. Each cross brace 50 is joined in the middle by a doubly pivoted spreader hinge 51 that allows better control and reduces the risk of pinching.

The handle 26 is attached in such a way that it can slip around the pole. It may also be covered with a flexible cover for carrying comfort.

The position of the compression spring 60 urges the pole series to spread upon deployment. Further detail of this section can be seen in FIG. 6*a*.

FIG. 6*a* is a detailed view of the far end portion of the barrier having the compression spring 60. A nylon threaded rod 622 passes through holes in two poles 35 and through a rubber sleeve 623 inside the compression spring 60. Nylon bushings 621 on each end of the rod are capped and secured by a nut 62 at each end.

The flexible joint 36 is also shown in greater detail. It is comprised of a flexible metal accordion folded tube 361 covered with an elastomeric tube 362. Both tubes are inserted into the ends of an extension tube 38 and a pole tube 35 and cemented into place 363.

FIG. 6*b* is a detail of the top connection of pairs of poles 35 that have brackets 64 or top hinges affixed with a bolt 602 inserted through a hole in the bracket 64 and through the pole 35. The brackets 64 each have extended flat pieces with matching holes through which a bolt 63 can be placed. Nylon washers 603 are placed between the two flat bracket extensions and on the ends of the bolts 602 and 63 allowing flexibility, smoothness of operation and resistance to corrosion. Nuts 601 secure each bolt. These top hinges or brackets 64 allow extension and retraction of the barrier while retaining solid fluid motion.

FIG. 6*c* is a side view of the bracket 64 and hinge shown in FIG. 6*b* showing the connection with another pair of poles 35. A bolt 63 can be seen in end view along with the location of nylon washers 603 between the two flat bracket extensions. An end view of a bolt 602 is shown. An end cap 301 on the top of a pole 35 is shown in the background.

The method of attachment a second pair of poles 35 to the first is also shown. At the point of attachment a bolt 34 (see also FIGS. 3 and 4) is passed through both poles 35. Washers between the two poles 35 (not shown) serve as spacers and reduce friction. A feature of one of the connecting bolts 34 is an extended threaded section to which a handle 39 can be affixed. This combination of connecting two series of poles 35 serves to form a 3-way hinge having sufficiently loose fit to enable rotation in at least 60 degrees of a vertical plane and at least 60 degrees in a perpendicular plane.

Figure 7:
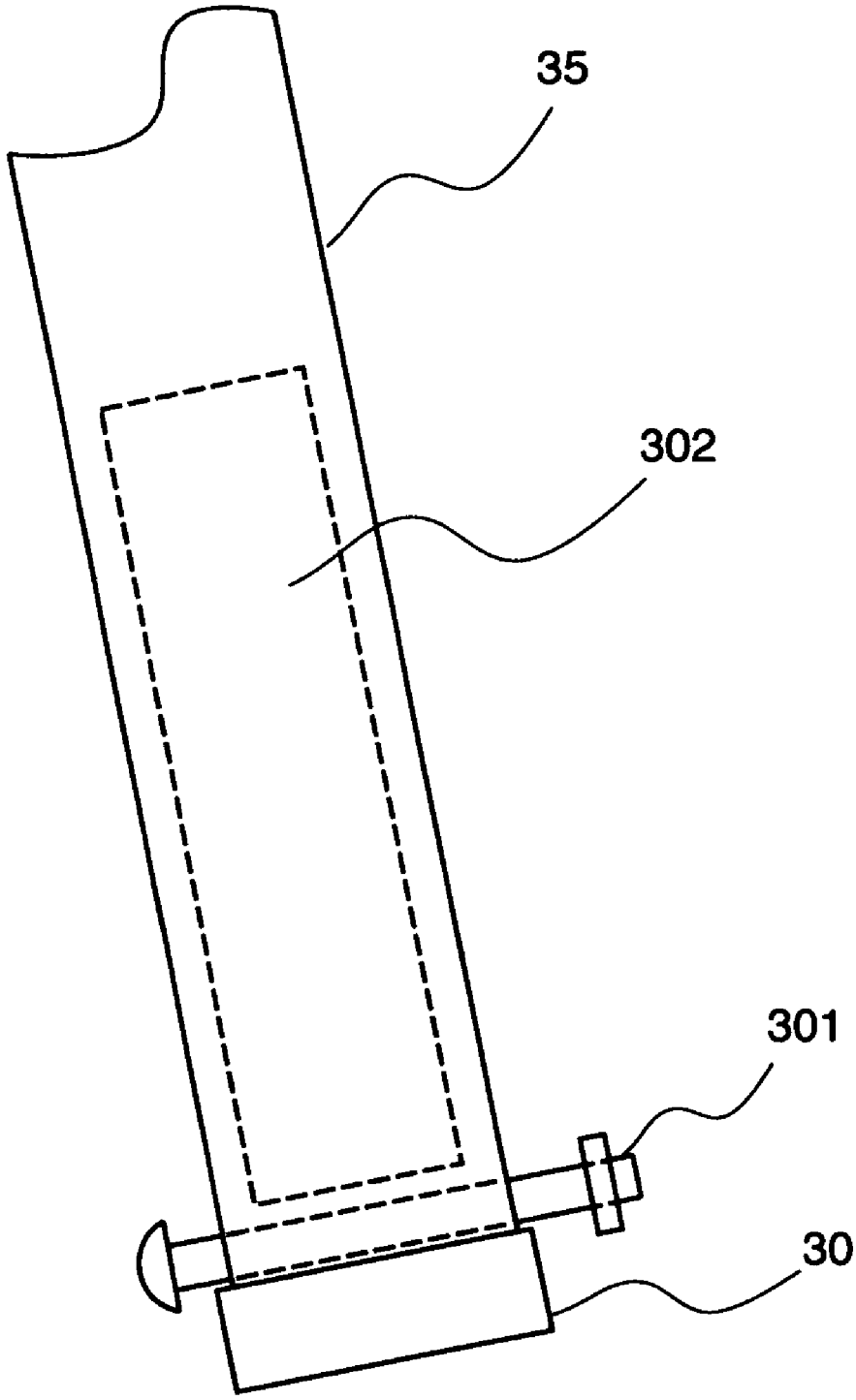
FIG. 7 is a view of the adaptation for weight addition.

FIG. 7 is a view of an embodiment with an adaptation for weight addition. One or more poles 35 of the barrier is hollow and by removing the end cap 30 and, if present, the plug, a solid dense rod 302 can be slipped into the pole 35 for greater ballast and stability. On construction sites reinforcing rod of an appropriate diameter and weight is typically available for use. A pole 35 may be further adapted by placing a hole near the bottom through which a bolt may be run and nut 301 attached after inserting the rod 302. The end cap 30 and if present, plug may then be replaced.

Figure 8:
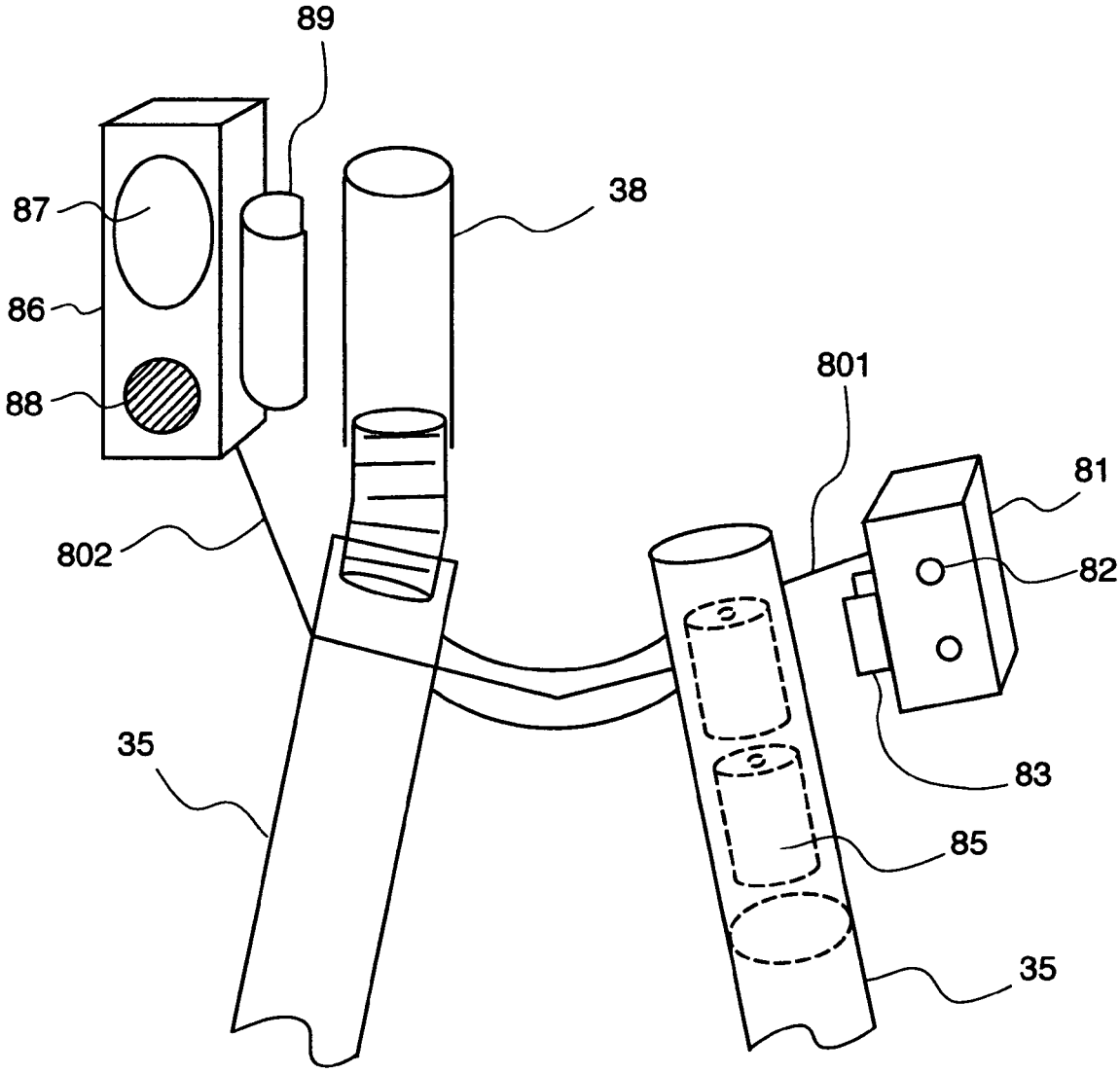
FIG. 8 is a view of signaling devices.

FIG. 8 is a schematic of a signaling device to enhance effectiveness of the barrier. A control box 81 houses electronics such as timers and switching circuits and provides for external adjustment using controls 82. Means for attachment 83 to one of the poles 35 is also provided. The means 83 may be spring clamps, hook and loop fasteners or bolts and is preferably semi-permanent. The control box 81 receives an electrical feed from a power pack 85 that, in this instance, is shown located in a hollow portion of one of the poles 35.

The control box 91 also distributes power to the signaling device 86. The signaling device 86 may include one or more of the following: a light source 87, an audio output device 88 and/or a sensor to detect approaching objects (not shown). An example of an appropriate sensor would be an ultrasonic sensor for close range developed by Polaroid Corporation for their cameras. The later would be especially useful if connected so as to provide a warning for a pedestrian who was distracted or visually impaired.

While the light source 87 is indicated as a single source, it is envisioned that it could also be a series of smaller lamps such as LED's that could be strung along or incorporated into the banner 40. The control circuitry could provide a continuous or intermittent light source 87. For power conservation purposes, the preferred embodiment would use low level continuous light sources coupled with an intermittent output to a charging circuit that would power higher output flash lamps. Further refinement would provide a low light level detector 99 so lights activate only when needed.

The control circuitry could include an audio oscillator to provide sound in the audible range for the audio output device 88.

The signaling device 86 also has a way to attach it securely to the barrier 10. One means for attachment is a spring clamp 89 that would slip onto one of the pole extensions 38. It is preferable, for visibility to manufacture the barrier in a highly visible color and material such as chartreuse, day glow or hunter orange, reflective beads or glow-in-the-dark (phosphorescent, chemi-luminescent or the like) materials.

While the banner shown only covers the area of the extensions, it could be extended downward, like an apron, for greater viability, to accommodate more information (such as DETOUR beneath and arrow, advertising, or festive colors for a parade.

Figure 9:
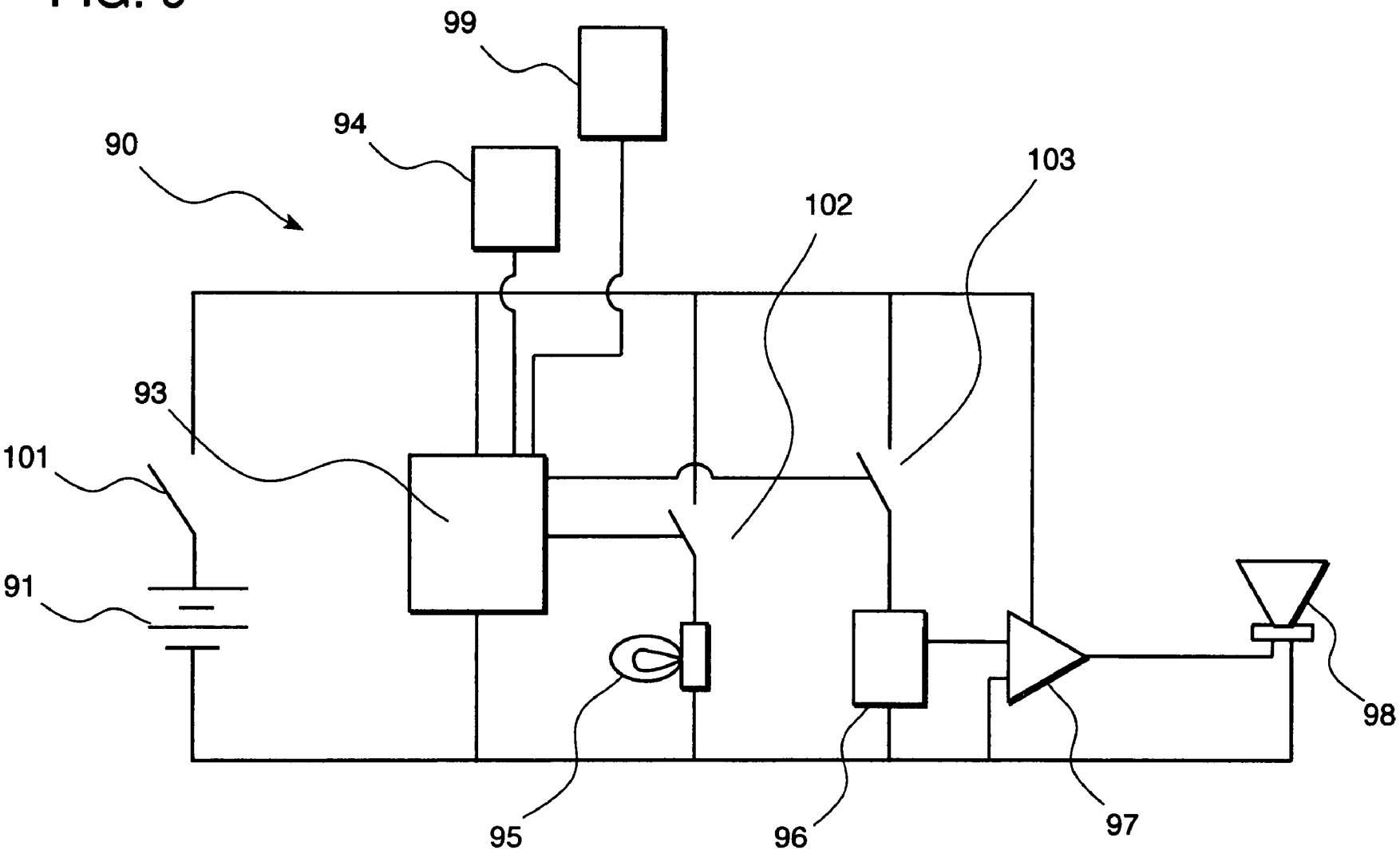
FIG. 9 is a representation of one embodiment of electrical circuits and controls

FIG. 9 is a schematic of one embodiment of a set of electronic controls, power distribution and signaling devices. The over-all schematic 90 includes a power source 91, in this instance a battery or series of batteries as is indicated along with a master control switch 101. A timing and control circuit 93 provides outputs responsive to chosen inputs from a proximity sensor 94 and low light sensor 99 to an illumination source 95 and/or an audio source 96 controlled by switches 102 and 103 respectively. The audio oscillator source 96 can have a power booster in the form of a speaker driver 97 and a speaker 98. The latter may be any low cost, low power devices including a piezo-based speaker 98.

What is claimed is:

1. A barrier comprising:

a first side being expandable and contractible in horizontal length and having a top and a bottom, a second side being expandable and contractible in horizontal length and having a top and a bottom, wherein said top of said second side is pivotally connected to said top of said first side to allow expansion and contraction in width to form a base of said barrier, said first side further comprising a first series of elongated members comprising a group of frontward, left inclining elongated members, and a group of frontward right inclining elongated members, such that each said frontward, left inclining member crosses a frontward right inclining elongated members near the midpoints of the frontward elongated members, and said frontward elongated members are pivotally connected at the midpoints and adjacent top and bottom ends of adjacent left inclining and right inclining frontward enlongated members, wherein at least one of said elongated members of said first series of elongated members is connected to a first end pole, and said second side further comprising a series of elongated members comprising a group of rearward, left inclining elongated members, and a group of rearward right inclining elongated members, such that each said rearward, left inclining elongated member crosses a rearward right inclining elongated member near the midpoints of the rearward elongated members, and said rearward elongated members are pivotally connected at the midpoints and adjacent top and bottom ends of adjacent left inclining and right inclining rearward enlongated members, and wherein at least one of said of elongated members of said second series of elongated members is connected to a second end pole, and having a means of adjusting the length of at least one member to minimize strain.

2. The barrier of claim 1 wherein said barrier is provided with a means for securing in a collapsed position.

3. The barrier of claim 2 further comprising means of connecting to a second barrier.

4. The barrier of claim 2 further comprising at least one carrying handle located on said first side.

5. The barrier of claim 1 wherein at least one end pole is a telescoping end pole.

6. The barrier of claim 1 wherein said elongated members are hollow to accept rods.

7. The barrier of claim 1 wherein said angle adapter comprises flexible steel tubing secured to the ends of said elongated members of said first side and to said extensions and are covered by an elastomeric tube.

8. The barrier of claim 1 wherein at least one collapsible brace is provided between said first side and said second side.

9. The barrier of claim 8 wherein at least one collapsible brace is provided with a central locking hinge having two pivots.

10. The barrier of claim 1 wherein said barrier is further provided with a compression spring for urging expansion of the width of said base.

11. The barrier of claim 1 wherein attachment between said first side and said second side allows the formation of at least a 60-degree angle.

12. The barrier of claim 1 further comprising a banner and at least two extensions located on the top of said first side for supporting said banner by insertion into pockets of the banner.

13. The barrier of claim 12 wherein said banner acts to limit expansion in horizontal length of said barrier to the length of the fully extended banner.

14. The barrier of claim 1 further comprising at least one handgrip attached to said first side for expanding said barrier.

15. The barrier of claim 1 further comprising at least one alerting device chosen from the group consisting of lights and sounds.

16. A barrier comprising:

a first side, said comprising a series of paired poles, being expandable and contractible in length by a scissoring action, the poles connected at a central pivot point, and having a top, a bottom, and an end pole wherein said one end pole is a telescoping end pole, a second side comprising a second series of paired poles, being expandable and contractible in length by a scissoring action, the poles connected at a central pivot point, and having a top and a bottom, wherein said top of said second side is pivotally connected to said top of said first side to allow expansion and contraction in width to form a base of said barrier, means for securing said barrier in a collapsed position comprised of straps attached to at least two elongated members, means of connecting said barrier to a second barrier, position comprised of straps attached to at least two elongated members, a banner and at least two extensions connected by angle adapters to the top of at least two of said first series of paired poles for supporting said banner, wherein said banner having pockets at extrema into which extensions are placed serve to limit expansion in length of said barrier, access to at least one of said paired poles to accept a rod for weight, a collapsible brace between said first side and said second side, said collapsible brace having a central locking hinge with two pivots, a compression spring for urging expansion of the width of said base, and at least one hand grip located on said first side.

* * * * *